US007925030B2

(12) United States Patent
Holmström et al.

(10) Patent No.: US 7,925,030 B2
(45) Date of Patent: Apr. 12, 2011

(54) CROSSTALK CANCELLATION USING LOAD IMPEDENCE MEASUREMENTS

(75) Inventors: Michael Holmström, Lund (SE); Bengt Edholm, Lund (SE); Sven Mattisson, Bjärred (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 1312 days.

(21) Appl. No.: 11/482,595

(22) Filed: Jul. 8, 2006

(65) Prior Publication Data

US 2008/0008325 A1 Jan. 10, 2008

(51) Int. Cl.
*H04R 1/10* (2006.01)
*H04R 5/00* (2006.01)

(52) U.S. Cl. ..... 381/74; 381/1; 381/17

(58) Field of Classification Search ..... 381/1, 17–18, 381/26–27, 74, 307, 309, 300, 310
See application file for complete search history.

(56) References Cited

U.S. PATENT DOCUMENTS 4,449,229 A * 5/1984 Mori ..... 381/2
4,868,878 A * 9/1989 Kunugi et al. ..... 381/1
5,119,420 A * 6/1992 Kato et al. ..... 381/1
5,434,921 A * 7/1995 Dombrowski et al. ..... 381/1
5,774,556 A * 6/1998 Lowe et al. ..... 381/17
5,854,847 A * 12/1998 Yoshida et al. ..... 381/302
6,754,350 B2 * 6/2004 Sugimoto ..... 381/17
6,870,933 B2 * 3/2005 Roovers ..... 381/27
2005/0184807 A1 8/2005 Doy et al.
2006/0023889 A1 2/2006 Suzaki et al.

* cited by examiner

*Primary Examiner* — Xu Mei

(57) ABSTRACT

A method and ASIC for canceling crosstalk between a first stereo channel and a second stereo channel, wherein a first signal is input to a first output amplifier for the first channel, and a second signal is input to a second output amplifier for the second channel, and an output load for each output amplifier is connected between each output amplifier and a reference amplifier. In one embodiment, the first and second signals are split prior to inputting the signals to the first and second output amplifiers, and a gain-adjusted portion of each signal is added to the other signal on the inputs of the output amplifiers. In another embodiment, the first and second input signals are again split into two paths each. While a first path of each signal is inputted to each signal's respective output amplifier, the second paths of the first and second signals are adding together. The resulting sum is adjusted by a gain function, biased by a suitable DC voltage, and input to the reference amplifier.

21 Claims, 6 Drawing Sheets

CROSSTALK CANCELLATION USING LOAD IMPEDENCE MEASUREMENTS

CROSS-REFERENCE TO RELATED APPLICATIONS

NOT APPLICABLE

STATEMENT REGARDING FEDERALLY SPONSORED RESEARCH OR DEVELOPMENT

NOT APPLICABLE

REFERENCE TO SEQUENCE LISTING, A TABLE, OR A COMPUTER PROGRAM LISTING COMPACT DISC APPENDIX

NOT APPLICABLE

BACKGROUND OF THE INVENTION

The present invention relates to systems for amplifying electronic signals. More particularly, and not by way of limitation, the present invention is directed to a system and method for canceling crosstalk between multiple channels using load impedance measurements.

Driving a stereo headset is a common requirement in today's mobile phones. There is a requirement to minimize the number of pins in the headset connector, and also to adhere to the standard headset connector found on most home music equipments. Typically, the standard headset has a three-terminal connector with left, right, and ground terminals. No DC current is allowed to flow through the headset. This requires the left and right signals to be an AC signal with a zero-volt DC offset. Such a signal may be generated using an amplifier with a positive and negative voltage supply. However, a negative supply is not readily available in a device operated by a single battery.

FIG. 1A is a simplified schematic drawing of a common configuration of stereo amplifiers for generating a stereo signal (i.e., left signal and right signal). The signal, $V_{in1}$ is fed into a first single-ended output amplifier (Output AMP1) 11, and the signal $V_{in2}$ is fed into a second single-ended output amplifier (Output AMP2) 12. The output amplifiers are providing the signal to a load such as headphones, speakers, etc. (not shown). The output amplifiers have a common-mode DC voltage equal to VDD/2. To prevent this voltage from creating a DC current flow through the load, DC-blocking capacitors ($C_{L1}$ and $C_{L2}$) 13 and 14 are used. The DC-blocking capacitors are needed in the absence of a negative voltage supply. A drawback with the DC-blocking capacitors is that they typically are 100-200 μF, each of which occupies significant area on a printed circuit board (PCB).

FIG. 1B is a simplified schematic drawing of another common configuration of stereo amplifiers for generating a stereo signal. This configuration utilizes a reference voltage supply (VMID) 15. The VMID driver is implemented as a reference amplifier (Reference AMP) 16 and provides half the voltage of the power supply (VDD/2) as a reference DC voltage level. A first output load ($R_{L1}$) 17 is connected between Output AMP1 11 and the Reference AMP. A second output load ($R_{L2}$) 18 is connected between Output AMP2 12 and the Reference AMP. The main reason for using the Reference AMP is to eliminate the DC blocking capacitors $C_{L1}$ and $C_{L2}$, thereby reducing the PCB area occupied and reducing the number of pins in the headphone jack.

FIG. 2 illustrates a problem that arises when using the Reference AMP 16 for the output amplifier loads. With this configuration, it is difficult to avoid crosstalk between the channels. The primary source of crosstalk is an output impedance ($R_{int}$) 19 in the Reference AMP 16. Crosstalk is injected from one channel to the other via this internal Reference AMP output impedance, $R_{int}$. If $R_{int}$ is 1 ohm, and the load is 32 ohms, the crosstalk will be −30.1 dB (Crosstalk=20 log 1/32). Generally, a small $R_{int}$ is more costly than a larger $R_{int}$. A method that will allow higher output impedance with the same crosstalk performance would thus save cost.

Instability can also be a problem with the Reference AMP configuration. Different configurations of the amplifier load result in differing capacitive and inductive loads. Too much capacitive load on the amplifier can easily make it unstable. It is known that the stability of an amplifier can be improved by adding a serial resistor between the Reference AMP output and the capacitive load. The drawback of adding more serial resistance to the output, however, is that it increases crosstalk between the channels.

It would be advantageous to have a system and method of crosstalk cancellation that overcomes the disadvantages of the prior art. The present invention provides such a system and method.

BRIEF SUMMARY OF THE INVENTION

The present invention is directed to a system and method for canceling crosstalk between multiple channels using load impedance measurements. In a first embodiment involving a stereo system, the signal from each channel is added to the other channel on the input of the output amplifiers. In a second embodiment, the signals from both channels are added on the input of the reference amplifier. While some distortion of the output signal will occur using both methods, the distortion will only affect the amplitude of the output signal level.

Thus, the present invention improves the crosstalk figure with crosstalk cancellation. Other advantages include the fact that the invention can be implemented in the digital region of an ASIC while using a minumum of silicon area. A low cost, low performance analog input amplifier, or an amplifier already existing in the ASIC, can be used as a measuring amplifier. The calculations performed in the present invention also provide a load resistance figure connected to the output amplifier. This information can be used to send a warning message to the user indicating that the load is not acceptable for the system. Also, the stability of the Reference AMP can indirectly be improved if the Reference AMP stability improves when adding a serial resistance between the Reference AMP and the load.

Thus, in one aspect, the present invention is directed to a method of canceling crosstalk between a first stereo channel and a second stereo channel, wherein a first signal is input to a first output amplifier for the first channel, and a second signal is input to a second output amplifier for the second channel, and an output load for each output amplifier is connected between each output amplifier and a reference amplifier. The method includes splitting the first and second signals prior to inputting the signals to the first and second output amplifiers; and adding a split portion of each signal to the other signal on the inputs of the first and second output amplifiers. The step of adding a split portion of each signal to the other signal may include adjusting each split signal by a programmable gain amplifier before adding the split signal to the other signal.

In another aspect, the present invention is directed to a method of canceling crosstalk between a first stereo channel and a second stereo channel, wherein a first signal is input to a first output amplifier for the first channel, and a second signal is input to a second output amplifier for the second channel, and an output load for each output amplifier is connected between each output amplifier and a reference amplifier. The method includes splitting the first signal onto a first path and a second path prior to an input of the second output amplifier, and adjusting the first signal on the first path by a first programmable gain amplifier. The second signal is split onto a third path and a fourth path prior to an input of the second output amplifier. The second signal on the third path is adjusted by a second programmable gain amplifier. The adjusted second signal on the third path is added to the first signal on the second path to create a first sum, and the adjusted first signal on the first path is added to the second signal on the fourth path to create a second sum. The first sum is input to the first output amplifier, and the second sum is input to the second output amplifier.

In another embodiment, the present invention is directed to a method of canceling crosstalk between a first stereo channel and a second stereo channel, wherein a first signal is input to a first output amplifier for the first channel, and a second signal is input to a second output amplifier for the second channel, and an output load for each output amplifier is connected between each output amplifier and a reference amplifier. The method includes splitting the first and second input signals into two paths each; inputting a first path of each signal to each signal's respective output amplifier; adding together a second path of the first and second signals; adjusting the sum of the first and second signals by a gain function; adding a suitable DC bias to the adjusted sum, and inputting the biased adjusted sum to the reference amplifier.

In yet another aspect, the present invention is directed to a Mixed Signal Application Specific Integrated Circuit (ASIC) of a mobile phone platform. The ASIC provides a first stereo channel and a second stereo channel to a headphone jack. The ASIC includes first and second output amplifiers. The first output amplifier amplifies a first input signal for the first channel, and supplies the first amplified signal to a first load associated with the headphone jack. The second output amplifier amplifies a second input signal for the second channel, and supplies the second amplified signal to a second load associated with the headphone jack. A reference amplifier provides a reference signal between the first and second loads. The ASIC also includes a crosstalk cancellation unit for canceling crosstalk between the first and second channels. The crosstalk cancellation unit includes means for splitting the first and second signals prior to inputting the signals to the first and second output amplifiers; and means for adding a split portion of each signal to the other signal on the inputs of the first and second output amplifiers.

In yet another aspect, the present invention is directed to a Mixed Signal ASIC of a mobile phone platform. The ASIC provides a first stereo channel and a second stereo channel to a headphone jack. The ASIC includes first and second output amplifiers. The first output amplifier amplifies a first input signal for the first channel, and supplies the first amplified signal to a first load associated with the headphone jack. The second output amplifier amplifies a second input signal for the second channel, and supplies the second amplified signal to a second load associated with the headphone jack. A reference amplifier provides a reference signal between the first and second loads. The ASIC also includes a crosstalk cancellation unit for canceling crosstalk between the first and second channels. The crosstalk cancellation unit includes first and second splitters for splitting the first and second input signals into two paths each; means for inputting a first path of each signal to each signal's respective output amplifier; and an adder for adding together a second path of the first and second signals. The crosstalk cancellation unit also includes a gain amplifier for adjusting the sum of the first and second signals and adding a suitable DC bias to the adjusted sum; and means for inputting the biased adjusted sum to the reference amplifier.

BRIEF DESCRIPTION OF THE SEVERAL VIEWS OF THE DRAWING

In the following section, the invention will be described with reference to exemplary embodiments illustrated in the figures, in which.

DETAILED DESCRIPTION OF EMBODIMENTS

The present invention is directed to a system and method for canceling crosstalk between multiple channels using load impedance measurements. Two exemplary embodiments are described herein in the context of an exemplary two-channel system. In a first embodiment illustrated in FIG. 3, the signal from each channel is added to the other channel on the input of the output amplifiers. In a second embodiment illustrated in FIG. 4, the signals from both channels are added on the input of the reference amplifier. Some distortion of the output signal will occur using both methods. However, the distortion will only affect the amplitude of the output signal level.

The amount of crosstalk can be calculated using the equation $R_{int}/R_L$, where $R_{int}$ is the Reference AMP output impedance, and $R_L$ is the load. This can be shown to be true from the following calculations. To simplify the calculations, certain assumptions regarding the amplifiers and their connected loads are made. The amplifiers are assumed to be linear and to have a flat frequency response within the audio frequency range (f<20 kHz). It is also assumed that the amplifier loads are not frequency dependent for the audio frequency range (f<20 kHz).

Figure 1A:
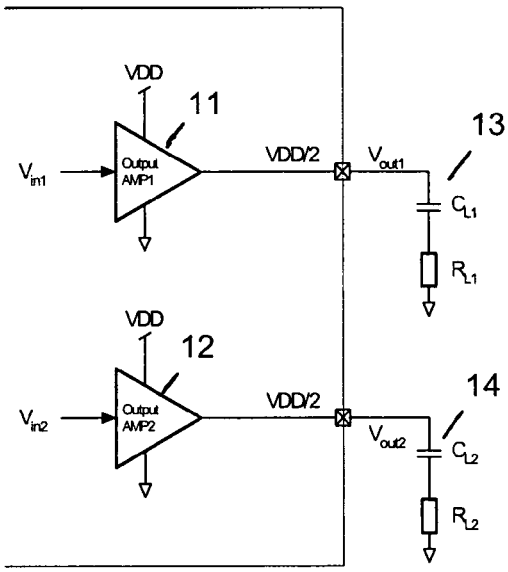
FIG. 1A (Prior Art)
FIG. 1A (Prior Art) is a simplified schematic drawing of a common configuration of stereo amplifiers for generating a stereo signal.
Figure 1B:
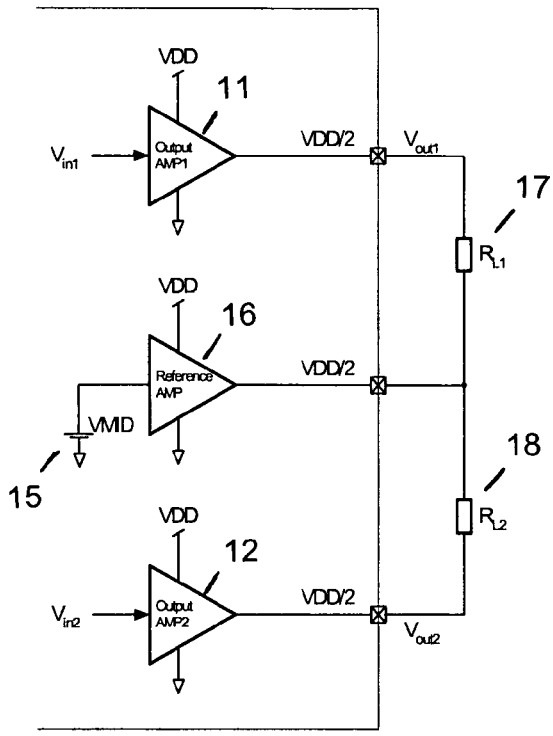
FIG. 1B (Prior Art)
FIG. 1B (Prior Art) is a simplified schematic drawing of another common configuration of stereo amplifiers for generating a stereo signal.
Figure 2:
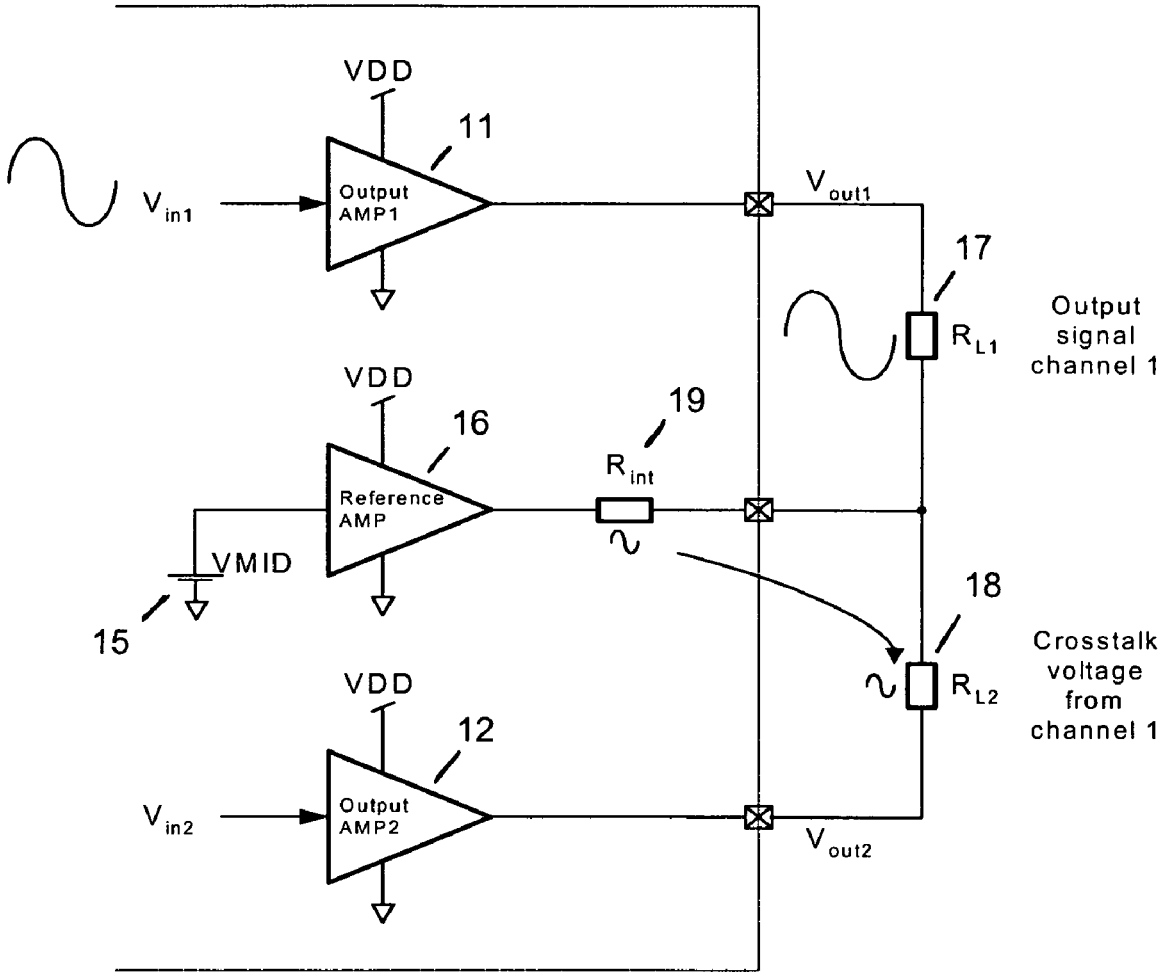
FIG. 2 (Prior Art)
FIG. 2 (Prior Art) illustrates a problem that arises when using the Reference AMP for the output amplifier loads.
Figure 3:
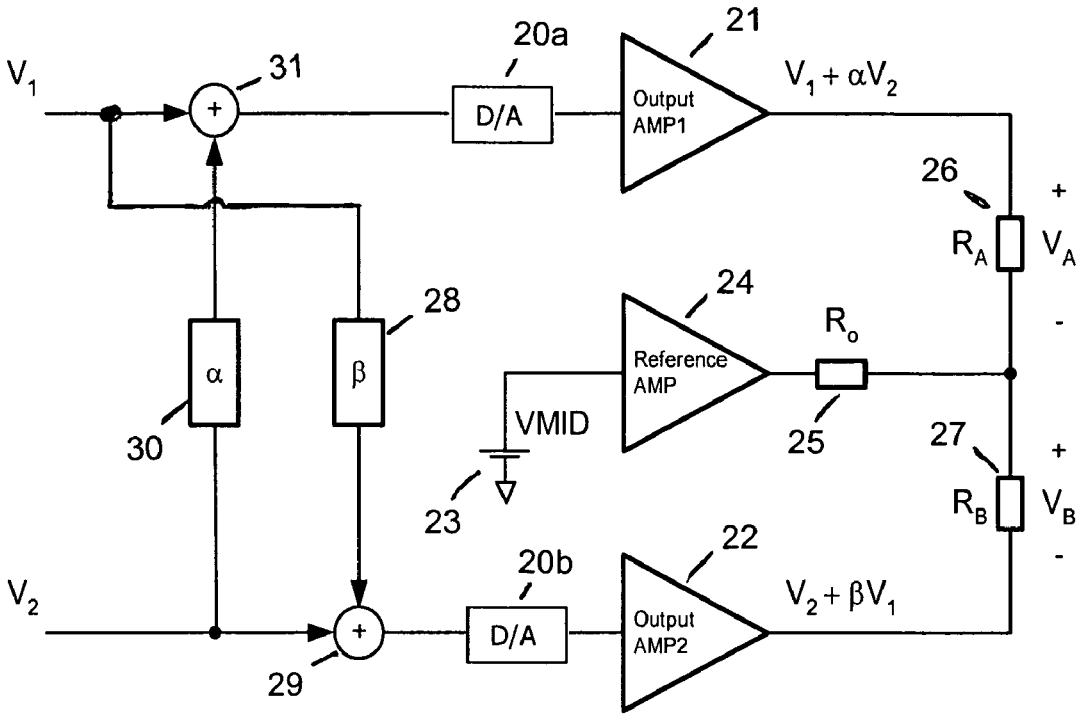
FIG. 3 is a simplified schematic drawing of an amplifier configuration in accordance with a first embodiment of the present invention.

FIG. 3 is a simplified schematic drawing of an amplifier configuration in accordance with the first embodiment of the present invention. In this embodiment, the signal from each channel is added to the other channel on the input of the output amplifiers. The signal $V_1$ is converted by a digital-to-analog (D/A) converter 20*a* and fed into a first single-ended output amplifier (Output AMP1) 21, and the signal $V_2$ is converted by a D/A converter 20*b* and fed into a second single-ended output amplifier (Output AMP2) 22. A reference voltage supply (VMID) 23 is implemented as an input to a reference amplifier (Reference AMP) 24. The Reference AMP has an internal output impedance $R_0$ 25, and generates a reference signal, which may be a reference DC voltage level. A first output load ($R_A$) 26 is connected between Output AMP1 21 and the Reference AMP. A voltage drop $V_A$ is associated with the first output load $R_A$. A second output load ($R_B$) 27 is connected between Output AMP2 22 and the Reference AMP. A voltage drop $V_B$ is associated with the second output load $R_B$.

The signal $V_1$ is split prior to Output AMP1 21, and is routed through a gain function β 28 to an adder 29 where the signal $V_1$ is added to the signal $V_2$. Likewise, the signal $V_2$ is split prior to Output AMP2 22, and is routed through a gain function α 30 to an adder 31 where the signal $V_2$ is added to the signal $V_1$. The gain functions α and β and the adders may be implemented in the digital domain, as shown, or in the analog domain. In the digital domain, the gain functions α and β may be implemented using programable gain amplifiers (PGAs). In the analog domain, the variable amplification and summing operations may be implemented using, for example, variable and fixed resistors.

The calculations below begin by showing that $V_A$ and $V_B$ are the signals that will appear over the resistive loads $R_A$ and $R_B$, respectively. Without loss of generality, all amplifiers are assumed to have 0 dB gain.

$$\begin{cases} V_A = (V_1 + \alpha V_2)\dfrac{R_A}{R_A + R_0 \| R_B} + (V_2 + \beta V_1)\dfrac{R_0 \| R_A}{R_B + R_0 \| R_A} \\ V_B = (V_2 + \beta V_1)\dfrac{R_B}{R_B + R_0 \| R_A} + (V_1 + \alpha V_2)\dfrac{R_0 \| R_B}{R_A + R_0 \| R_B} \end{cases} \tag{1}$$

Note that the symbol "μ" in all equations indicates that the resistors, R, on either side of the symbol are connected in parallel.

Total crosstalk cancellation will occur if the contribution from $V_2$ over load $R_A$ and the contribution from $V_1$ over load $R_B$ are completely cancelled out:

$$\begin{cases} \alpha V_2 \dfrac{R_A}{R_A + R_0 \| R_B} + V_2 \dfrac{R_0 \| R_A}{R_B + R_0 \| R_A} = 0 \\ \beta V_1 \dfrac{R_B}{R_B + R_0 \| R_A} + V_1 \dfrac{R_0 \| R_B}{R_A + R_0 \| R_B} = 0 \end{cases} \tag{2}$$

Assuming:

$$R_A = R_B R >> R_0 \tag{3}$$

The factors of crosstalk to reach total cancellation are given by:

$$\begin{cases} \alpha \dfrac{R}{R + R_0} + \dfrac{R_0}{R + R_0} = 0 \Rightarrow \alpha = -\dfrac{R_0}{R} \\ \beta \dfrac{R}{R + R_0} + \dfrac{R_0}{R + R_0} = 0 \Rightarrow \beta = -\dfrac{R_0}{R} \end{cases} \tag{4}$$

This shows that the crosstalk signal level needed for total cancellation is equal to $-R_0/R = -R_{int}/R_L$. It also proves that crosstalk from the Reference AMP output impedance $R_0$ for this implementation can be assumed to be $R_{int}/R_L$.

The output signals $V_A$ and $V_B$ will be affected by the amount of added crosstalk signal on each channel as shown by:

$$\begin{cases} V_A = (V_1 + \alpha V_2)\dfrac{R_A}{R_A + R_0 \| R_B} + (V_2 + \beta V_1)\dfrac{R_0 \| R_A}{R_B + R_0 \| R_A} \\ V_B = (V_2 + \beta V_1)\dfrac{R_B}{R_B + R_0 \| R_A} + (V_1 + \alpha V_2)\dfrac{R_0 \| R_B}{R_A + R_0 \| R_B} \end{cases} \tag{5}$$

$$\begin{cases} V_A = V_1\left(\dfrac{R}{R + R_0} + \left(-\dfrac{R_0}{R}\right)\dfrac{R_0}{R + R_0}\right) = \\ \quad = V_1\left(\dfrac{R}{R + R_0} - \dfrac{R_0^2}{R^2 + R_0 R}\right) \\ \quad = V_1 \dfrac{R - R_0^2/R}{R + R_0} \\ V_B = V_2\left(\dfrac{R}{R + R_0} + \left(-\dfrac{R_0}{R}\right)\dfrac{R_0}{R + R_0}\right) = \\ \quad = V_2\left(\dfrac{R}{R + R_0} - \dfrac{R_0^2}{R^2 + R_0 R}\right) \\ \quad = V_2 \dfrac{R - R_0^2/R}{R + R_0} \end{cases}$$

Assuming $R_A = R_B = R = 100\Omega$ and $R_0 = 1\Omega$:

$$\begin{cases} V_A = V_1 \dfrac{R - R_0^2/R}{R + R_0} = V_1 \dfrac{99.99}{101} = 0.99 V_1 \\ V_B = V_2 \dfrac{R - R_0^2/R}{R + R_0} = V_2 \dfrac{99.99}{101} = 0.99 V_2 \end{cases} \tag{6}$$

Thus, the first embodiment cancels out the small amount of signal level from one channel that occurs over the load resistance in the other channel by adding the same amount of inverted signal level at the input of the amplifiers.

Figure 4:
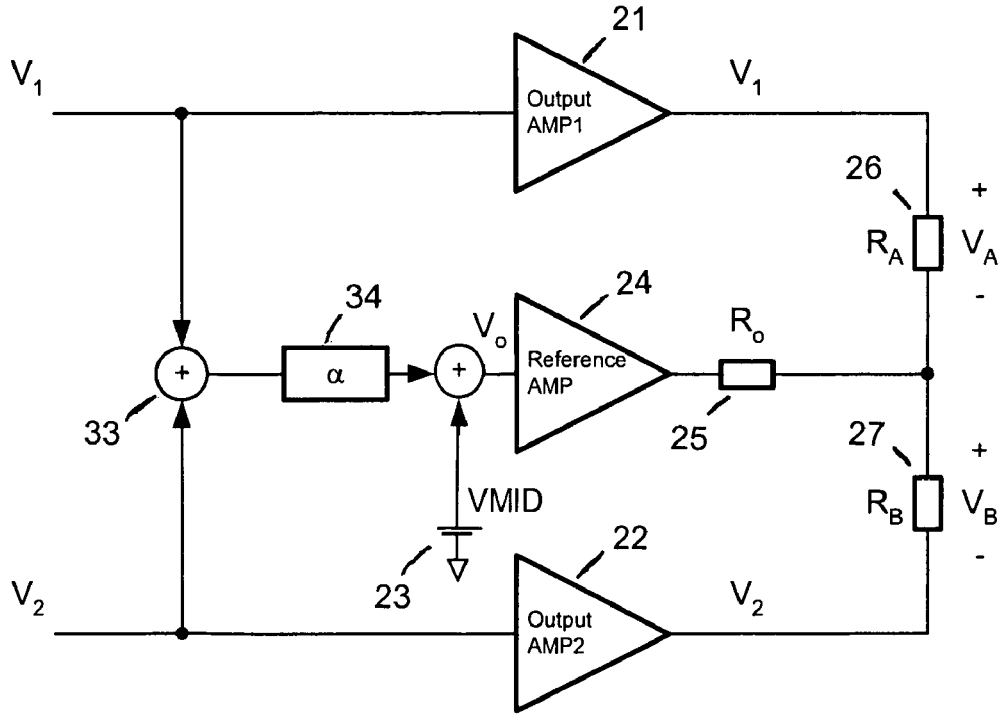
FIG. 4 is a simplified schematic drawing of an amplifier configuration in accordance with a second embodiment of the present invention.

FIG. 4 is a simplified schematic drawing of an amplifier configuration in accordance with the second embodiment of the present invention. In this embodiment, the signals from both channels are added on the input of the reference amplifier. The signals $V_1$ and $V_2$ are split prior to their respective Output AMPs, and are routed through an adder 33 and a gain function α 34. A suitable DC bias, VMID 23, is added to the adjusted sum before voltage $V_0$ is applied to the Reference AMP 24. The Reference AMP generates a reference signal, which may be a reference DC voltage level. Note that the added DC bias may be zero, depending on the values of $V_1$ and $V_2$, respectively.

Like in the first embodiment, it can be shown that this embodiment also results in crosstalk equal to $-R_0/R = -R_{int}/R_L$. The calculations below begin by showing that $V_A$ and $V_B$ are the signals that will appear over the resistive loads $R_A$ and $R_B$, respectively. Without loss of generality, all amplifiers are assumed to have 0 dB gain.

$$\begin{cases} V_A = V_1 \dfrac{R_A}{R_A + R_0 \| R_B} + V_0 \dfrac{R_A \| R_B}{R_0 + R_A \| R_B} + V_2 \dfrac{R_0 \| R_A}{R_B + R_0 \| R_A} \\ V_B = V_2 \dfrac{R_B}{R_B + R_0 \| R_A} + V_0 \dfrac{R_A \| R_B}{R_0 + R_A \| R_B} + V_1 \dfrac{R_0 \| R_B}{R_A + R_0 \| R_B} \end{cases} \tag{7}$$

Total crosstalk cancellation is achieved when:

$$V_0 = -V_1 \frac{R_0 \| R_B}{R_A + R_0 \| R_B} - V_2 \frac{R_0 \| R_A}{R_B + R_0 \| R_A} \tag{8}$$

The factor of crosstalk to reach total cancellation and assuming (3) is given by:

$$V_0 = -V_1 \frac{R_0}{R + R_0} - V_2 \frac{R_0}{R + R_0} = V_1 \alpha + V_2 \alpha = \alpha(V_1 + V_2) \tag{9}$$

$$\alpha = -\frac{R_0}{R + R_0} \sim -\frac{R_0}{R}$$

when $R_0 \ll R$.

The output signals $V_A$ and $V_B$ will be affected by the amount of added crosstalk signal on each channel, as shown by:

$$\begin{cases} V_A = V_1 \dfrac{R_A - R_0 \| R_B}{R_A + R_0 \| R_B} \\ V_B = V_2 \dfrac{R_B - R_0 \| R_A}{R_A + R_0 \| R_A} \end{cases} \tag{10}$$

Assuming (3):

$$\begin{cases} V_A = V_1 \dfrac{R - R_0}{R + R_0} \\ V_B = V_2 \dfrac{R - R_0}{R + R_0} \end{cases} \tag{11}$$

Assuming $R_A = R_B = R = 100\Omega$ and $R_0 = 1\Omega$:

$$\begin{cases} V_A = V_1 \dfrac{100 - 1}{100 + 1} = 0.98 V_1 \\ V_B = V_2 \dfrac{100 - 1}{100 + 1} = 0.98 V_2 \end{cases} \tag{12}$$

Both embodiments shown in FIGS. 3 and 4 can easily be implemented and used for crosstalk cancellation. For simplicity, only the first embodiment is chosen here to show how an implementation can be done in an existing Mixed Signal ASIC of a mobile phone platform.

Figure 5:
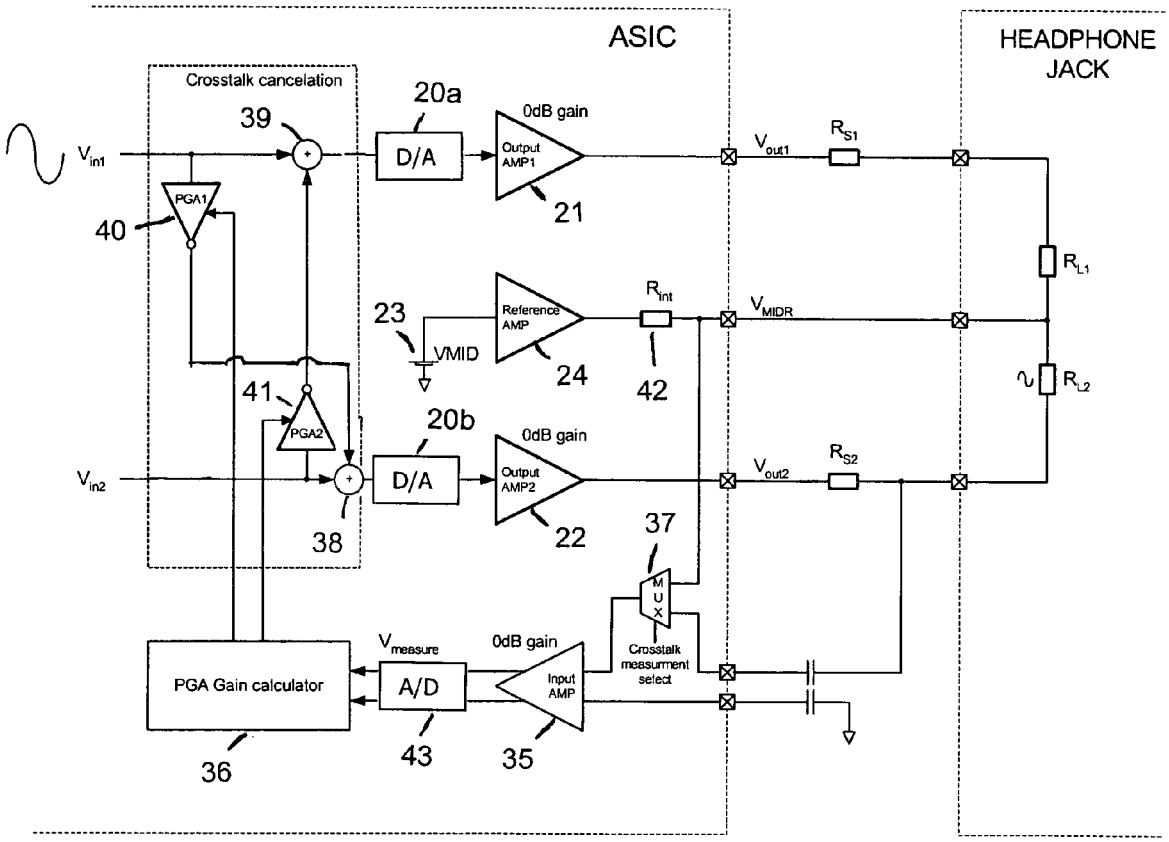
FIG. 5 is a simplified schematic drawing of an implementation of an amplifier configuration in an existing Mixed Signal ASIC of a mobile phone platform in accordance with the first embodiment of the present invention.

FIG. 5 is a simplified schematic drawing of an implementation of an amplifier configuration in a Mixed Signal Application Specific Integrated Circuit (ASIC) of a mobile phone platform in accordance with the first embodiment of the present invention. The crosstalk level increases as the load resistance decreases. For example, a 16Ω headset will have larger crosstalk than a 32Ω headset. If the platform cannot predict the impedance of the load, the impedance must be measured. The load impedance is determined by calculating the relationship between the load impedance ($R_{L1}$ and $R_{L2}$) and the resistance in serial of $R_L$ ($R_{L1}$ and $R_{L2}$) and $R_S$ ($R_{S1}$ and $R_{S2}$). In a first embodiment, the arrangement is implemented entirely in the analog domain, and thus the digital-to-analog (D/A) converters 20*a* and 20*b*, and the analog-to-digital (A/D) converter 43 are not present. The variable gain and summing operations performed in the crosstalk cancellation section may be performed by variable and fixed resistors. An analog amplifier 35 measures the impedance level and sends the information to an analog PGA gain calculator 36. If the headset is equipped with two cords to each headphone speaker, as found in a stereo headset, the total cord impedance is included in $R_{L1}$ and $R_{L2}$ and can be measured. In an alternative configuration, the crosstalk cancellation circuit and the PGA gain calculator are digital, and PGA1 40 and PGA2 41 are utilized in the crosstalk cancellation circuit to perform the variable gain function. The configuration utilizes the A/D converter 43 using a DC voltage measurement instead of the analog amplifier 35 with an AC voltage measurement. In another alternative configuration, the crosstalk cancellation circuit and the PGA gain calculator are digital, and the configuration utilizes both the analog amplifier 35 and the A/D converter 43, as illustrated in FIG. 5.

The crosstalk level also increases if the headset is equipped with one common cord to the headphone speakers. In this case, the common cord is not included in $R_{L1}$ and $R_{L2}$. The common cord impedance must then be known in case crosstalk cancellation from that impedance is needed.

The amount of PGA gain can also be calculated from an internal measurement directly from the Reference AMP output signal by using a multiplexer (MUX) 37. The signal measurement may be a voltage measurement, a current measurement, or a combination of voltage and current.

Using the configuration of FIG. 5, three scenarios for crosstalk cancellation may arise:

1. When $R_L$ is known (i.e., crosstalk cancellation with pre-loaded PGA gain);
2. When $R_L$ is unknown (load impedance must first be measured); and
3. When internal crosstalk measurements are taken on the Reference AMP output. In this scenario, a MUX may be utilized to select between external and internal measurements.

The crosstalk cancellation may be implemented by using adders 38 and 39, and programmable gain amplifiers PGA1 40 and PGA2 41 with negative gain settings in front of the original output amplifiers.

In scenario 1, when $R_L$ is known, the amount of PGA gain can be calculated directly using:

$$G_{PGA} = 20\log\frac{R_{int}}{R_L} = 20\log\frac{1}{32} = -30.1 \text{ dB}$$

where the internal output impedance is assumed to be 1Ω and the load impedance is assumed to be 32Ω. With this result, the PGA gain calculator 36 can set the correct PGA gain.

In scenario 2, when $R_L$ is unknown, the correct amount of crosstalk cancellation is calculated through the following steps in the given order:

A. Determine the internal output impedance $R_{int}$ 42 of the Reference AMP 24 and the headset cord impedance (if the headset is equipped with one common cord) to the headphone speakers.

B. Measure the load impedance ($R_{L1}$ and $R_{L2}$); and

C. Calculate the PGA setting.

For step A, to determine $R_{int}$ 42, the $R_{int}$ is given by the amplifier design. For the examples given below, the $R_{int}$ is assumed to be 1Ω. The headset cord impedance, if the headset is equipped with one common cord, can be found by measurement or from the supplier.

For step B, to optimize the crosstalk cancellation for any load, the amplifier load $R_L$ ($R_{L1}$ and $R_{L2}$) must be measured. This requires that the $R_{int}$ and $R_S$ ($R_{S1}$ and $R_{S2}$) be known, and that the input signal level $V_{in}$ be known. The output impedance of $R_L$ is then measured as shown in FIG. 5.

$$V_{In1} = V_{out1} \quad V_{In2} = V_{out2} \tag{13}$$

$$V_{measure1} = V_{out2} \cdot \frac{R_{L1} + R_{int}}{R_{L1} + R_{int} + R_{S1}}$$

$$V_{measure2} = V_{out1} \cdot \frac{R_{L2} + R_{int}}{R_{L2} + R_{int} + R_{S2}} \tag{14}$$

Alternatively assume $R_{L1}=R_{L2} \rightarrow V_{measure1}=V_{measure2}$.

As an example of how the $R_L$ can be calculated, it can be assumed that $R_S$=100Ω, $V_{out}$=1V, and $V_{measure}$=0.767V. Then:

$$R_{int} = 1\Omega$$

$$R_L = \frac{1 - \left(11 \cdot \left(\frac{V_{measure}}{V_{out}}\right)\right)}{\left(\frac{V_{measure}}{V_{out}}\right) - 1}$$

$$\frac{V_{measure}}{V_{out}} = 0.767$$

$$R_L = 31.92\Omega$$

Note that it is the relation of a signal provided to the channel and the measured signal level provided by the input amplifier (Input AMP) 35 that indirectly gives the load impedance figure.

For step C, calculate the PGA setting, when the load resistance is known, the calculation of the right amount of signal added through the PGA to each channel can be calculated as follows:

$$G_{PGA} = 20\log\frac{R_{int}}{R_L} \tag{15}$$

For example:

$$G_{PGA} = 20\log\frac{R_{int}}{R_L} = 20\log\frac{1}{31.92} = -30.08 \text{ dB}$$

The PGA gain calculator 36 can then set the correct PGA gain.

The final scenario considered is when internal crosstalk measurements are taken on the Reference AMP output. This measurement is performed using the MUX 37 to select and measure the $V_{MIDR}$ voltage level. Calculation of PGA gain can be done in the following ways:

$$V_{In1} = V_{out1} \quad V_{In2} = V_{out2} \quad V_{measure} = V_{MIDR}$$

$$G_{PGA} = 20\log\frac{V_{measure}}{V_{in1}}$$

The PGA gain calculator 36 can then set the correct PGA gain.

In an alternative embodiment of the amplifier configuration of FIG. 5, digital-to-analog (D/A) converters 20*a* and 20*b* are implemented prior to Output AMP1 21 and Output AMP2 22, respectively. The conversion back to digital is performed by the A/D converter 43. Of course, those skilled in the art would recognize that the digital and analog domains may be defined differently by implementing the D/A and A/D converters at different locations in the circuit. For example, instead of performing the crosstalk cancellation in the digital domain, as shown, the variable amplification and summing operations could be performed in the analog domain using, for example, variable and fixed resistors.

Figure 6:
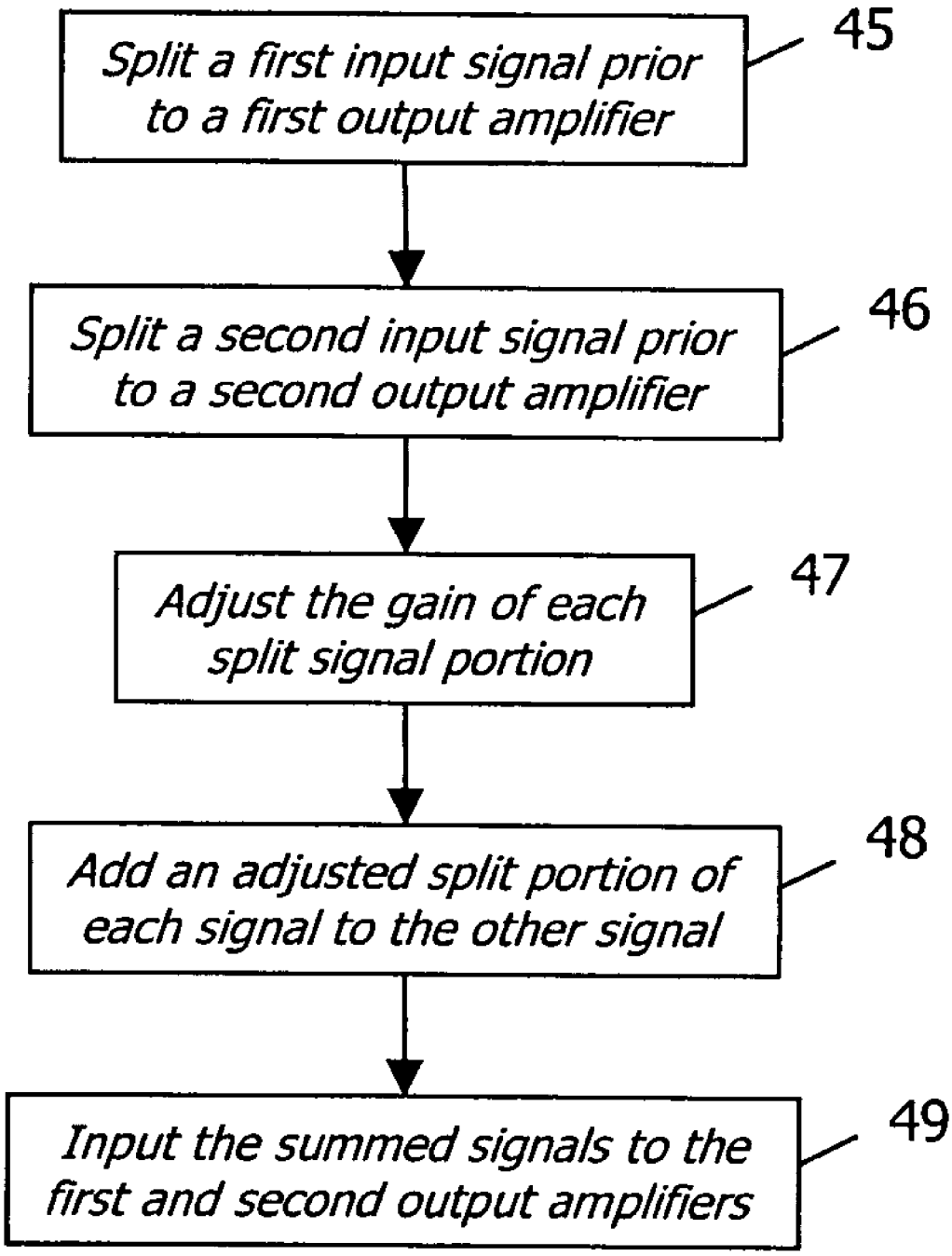
FIG. 6 is a flow chart illustrating the steps of a first embodiment of the method of the present invention.

FIG. 6 is a flow chart illustrating the steps of a first embodiment of the method of the present invention. Referring to FIGS. 3 and 6, a first signal is input to a first output amplifier 21 for the first channel, and a second signal is input to a second output amplifier 22 for the second channel, and an output load 26 and 27 for each output amplifier is connected between each output amplifier and a reference amplifier 24. At step 45, the first signal is split prior to the input of the first output amplifier. At step 46, the second signal is split prior to the input of the second output amplifier. At step 47, the gain of each split signal is adjusted in gain function β 28 and gain function α 30. At step 48, the adjusted split portions of each signal are added to the other signal in adders 29 and 31. At step 49, the summed signals are input to the first and second output amplifiers.

Figure 7:
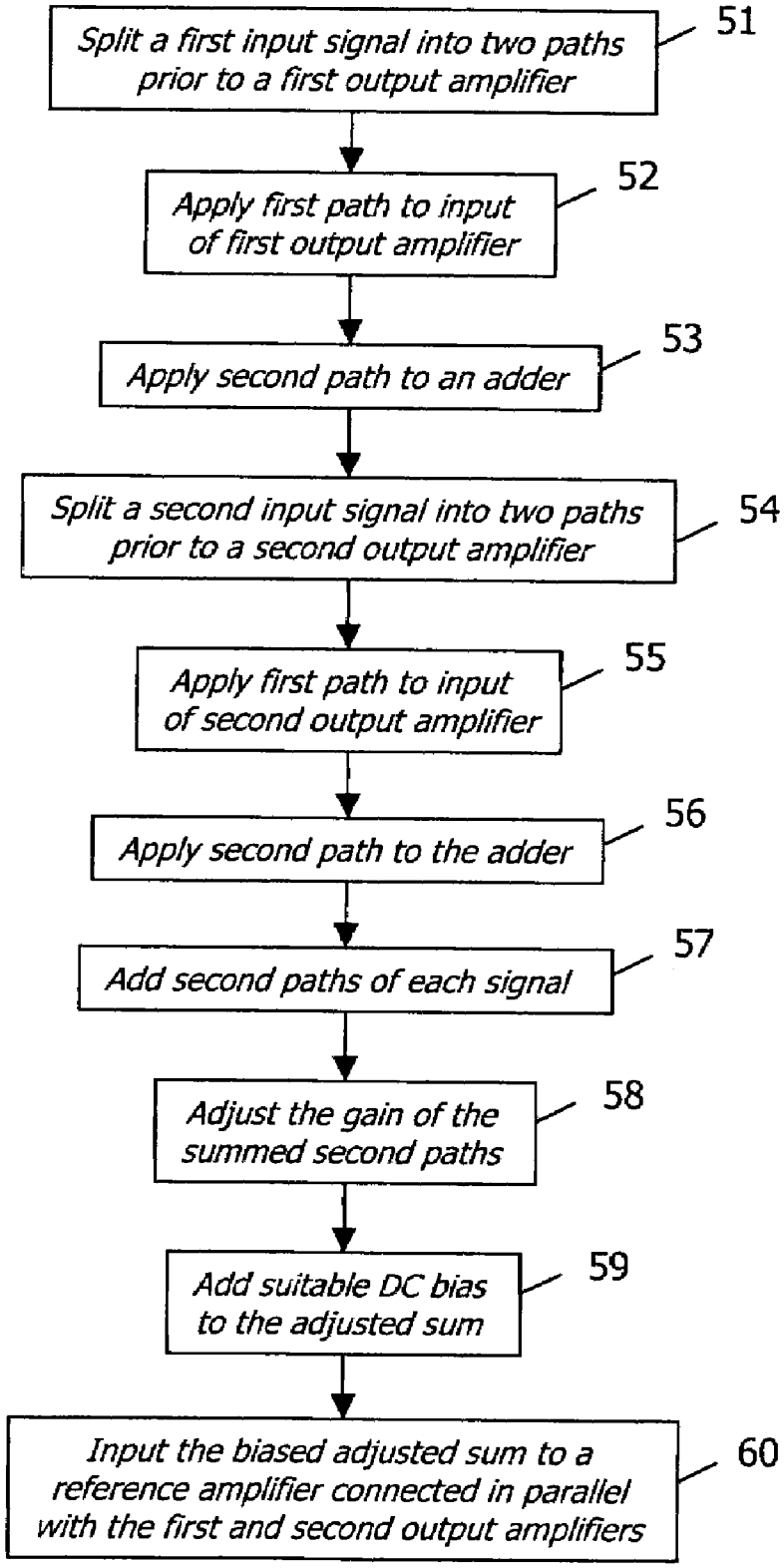
FIG. 7 is a flow chart illustrating the steps of a second embodiment of the method of the present invention.

FIG. 7 is a flow chart illustrating the steps of a second embodiment of the method of the present invention. Referring to FIGS. 4 and 7, a first signal is input to a first output amplifier 21 for the first channel, and a second signal is input to a second output amplifier 22 for the second channel, and an output load 26 and 27 for each output amplifier is connected between each output amplifier and a reference amplifier 24. At step 51, a first input signal is split into two paths prior to the first output amplifier. At step 52, the first path is input to the first output amplifier. At step 53, the second path is applied to an adder 33. At step 54, a second input signal is split into two paths prior to the second output amplifier. At step 55, the first path is input to the second output amplifier. At step 53, the second path is applied to the adder. At step 57, the second paths of each signal are added, and at step 58 the gain of the summed second paths is adjusted by the gain function a 34. At step 59, a suitable DC bias is added to the adjusted sum. At step 60, the biased adjusted sum is input to the reference amplifier 24 connected in parallel with the first and second output amplifiers.

Thus, the crosstalk figure can be improved with crosstalk cancellation. The present invention can be implemented in the digital region of an ASIC while using a minimum of silicon area. A low cost, low performance analog input amplifier, or an amplifier already existing in the ASIC, can be used as a measuring amplifier.

The calculation also gives the load resistance figure connected to the output amplifier. This information can be used to send a warning message to the user indicating that the load is not acceptable for the platform.

The stability of the Reference AMP can indirectly be improved if the Reference AMP stability improves when adding a serial resistance between the Reference AMP and the load.

As will be recognized by those skilled in the art, the innovative concepts described in the present application can be modified and varied over a wide range of applications. For example, although the description herein has focused on a two-channel stereo implementation, the invention is also applicable to crosstalk cancellation in multi-channel implementations. Accordingly, the scope of patented subject matter should not be limited to any of the specific exemplary teachings discussed above, but is instead defined by the following claims.

What is claimed is:

1. A method of canceling crosstalk between a first channel and a second channel, wherein a first signal is input to a first output amplifier for the first channel, and a second signal is input to a second output amplifier for the second channel, and an output load for each output amplifier is connected between each output amplifier and a reference amplifier, said method comprising:

splitting the first and second input signals into two paths each;

inputting a first path of each signal to each signal's respective output amplifier;

adding together a second path of the first and second signals;

adjusting the sum of the first and second signals by a gain function;

adding a suitable DC bias to the adjusted sum, and inputting the biased adjusted sum to the reference amplifier.

2. An arrangement for providing a first channel and a second channel to a headphone jack, said arrangement comprising:

a first output amplifier for amplifying a first input signal for the first channel, said first amplified signal being supplied to a first load associated with the headphone jack;

a second output amplifier for amplifying a second input signal for the second channel, said second amplified signal being supplied to a second load associated with the headphone jack;

a reference amplifier for providing a reference signal between the first and second loads; and a crosstalk cancellation unit for canceling crosstalk between the first and second channels, said crosstalk cancellation unit comprising:

means for splitting the first and second signals prior to inputting the signals to the first and second output amplifiers; and means for adding a split portion of each signal to the other signal on the inputs of the first and second output amplifiers.

3. The arrangement of claim 2, wherein the means for adding a split portion of each signal to the other signal includes adjusting each split signal by a gain function before adding the split signal to the other signal.

4. The arrangement of claim 3, wherein the reference amplifier has a known internal output impedance ($R_{int}$), the first and second loads ($R_L$) are known, and the gain function is a programmable gain amplifier (PGA), and wherein the arrangement further comprises a PGA gain calculator for calculating the gain of the PGA based on the known internal output impedance of the reference amplifier and the known first and second loads.

5. The arrangement of claim 4, wherein the PGA gain calculator calculates the gain of the PGA using the equation, $G_{PGA}=20 \log R_{int}/R_L$.

6. The arrangement of claim 3, wherein the reference amplifier has a known internal output impedance ($R_{int}$), the gain function is a programmable gain amplifier (PGA), and the arrangement further comprises:

means for measuring the impedance of the first and second loads ($R_L$); and a PGA gain calculator for calculating the gain of the PGA based on the known internal output impedance of the reference amplifier and the measured first and second loads.

7. The arrangement of claim 6, wherein the PGA gain calculator calculates the gain of the PGA using the equation, $G_{PGA}=20 \log R_{int}/R_L$.

8. The arrangement of claim 3, wherein the reference amplifier has a known internal output impedance ($R_{int}$), the gain function is a programmable gain amplifier (PGA), and the arrangement further comprises:

a crosstalk measurement multiplexer and input amplifier for measuring the signal level of the reference amplifier; and a PGA gain calculator connected to the multiplexer for calculating the gain of the PGA based on the measured signal level of the reference amplifier.

9. The arrangement of claim 8, wherein the PGA gain calculator calculates the gain of the PGA using the equation, $G_{PGA}=20 \log V_{measure}/V_{in1}$, where $V_{measure}$ is the measured voltage level of the reference amplifier, and $V_{in1}$ is the voltage level of the first input signal.

10. The arrangement of claim 3, wherein the reference amplifier has a known internal output impedance ($R_{int}$), the gain function is a programmable gain amplifier (PGA), and the arrangement further comprises:

a crosstalk measurement analog-to-digital (A/D) converter and input amplifier for measuring the signal level of the reference amplifier; and a PGA gain calculator connected to the A/D converter for calculating the gain of the PGA based on the measured signal level of the reference amplifier.

11. The arrangement of claim 2, wherein the arrangement is implemented as a Mixed Signal Application Specific Integrated Circuit (ASIC) of a mobile phone platform.

12. An arrangement for providing a first channel and a second channel to a headphone jack, said arrangement comprising:

a first output amplifier for amplifying a first input signal for the first channel, said first amplified signal being supplied to a first load associated with the headphone jack;

a second output amplifier for amplifying a second input signal for the second channel, said second amplified signal being supplied to a second load associated with the headphone jack;

a reference amplifier for providing a reference signal between the first and second loads; and a crosstalk cancellation unit for canceling crosstalk between the first and second channels, said crosstalk cancellation unit comprising:

first and second splitters for splitting the first and second input signals into two paths each;

means for inputting a first path of each signal to each signal's respective output amplifier;

a first adder for adding together a second path of the first and second signals;

a gain function for adjusting the sum of the first and second signals;

a second adder for adding a suitable DC bias to the adjusted sum; and means for inputting the biased adjusted sum to the reference amplifier.

13. The arrangement of claim 12, wherein the gain function is a programmable gain amplifier (PGA).

14. The arrangement of claim 13, wherein the reference amplifier has a known internal output impedance ($R_{int}$) and the first and second loads ($R_L$) are known, and the arrangement further comprises a PGA gain calculator for calculating the gain of the PGA based on the known internal output impedance of the reference amplifier and the known first and second loads.

15. The arrangement of claim 14, wherein the PGA gain calculator calculates the gain of the PGA using the equation, $G_{PGA}=20 \log R_{int}/R_L$.

16. The arrangement of claim 13, wherein the reference amplifier has a known internal output impedance ($R_{int}$) and the arrangement further comprises:

means for measuring the impedance of the first and second loads ($R_L$); and a PGA gain calculator for calculating the gain of the PGA based on the known internal output impedance of the reference amplifier and the measured first and second loads.

17. The arrangement of claim 16, wherein the PGA gain calculator calculates the gain of the PGA using the equation, $G_{PGA}=20 \log R_{int}/R_L$.

18. The arrangement of claim 13, wherein the reference amplifier has a known internal output impedance ($R_{int}$) and the arrangement further comprises:

a crosstalk measurement multiplexer and input amplifier for measuring the signal level of the reference amplifier; and a PGA gain calculator connected to the multiplexer for calculating the gain of the PGA based on the measured signal level of the reference amplifier.

19. The arrangement of claim 18, wherein the PGA gain calculator calculates the gain of the PGA using the equation, $G_{PGA}=20 \log V_{measure}/V_{in1}$, where $V_{measure}$ is the measured voltage level of the reference amplifier, and $V_{in1}$ is the voltage level of the first input signal.

20. The arrangement of claim 13, wherein the reference amplifier has a known internal output impedance ($R_{int}$) and the arrangement further comprises:

a crosstalk measurement analog-to-digital (A/D) converter and input amplifier for measuring the signal level of the reference amplifier; and a PGA gain calculator connected to the A/D converter for calculating the gain of the PGA based on the measured signal level of the reference amplifier.

21. The arrangement of claim 12, wherein the arrangement is implemented as a Mixed Signal Application Specific Integrated Circuit (ASIC) of a mobile phone platform.

* * * * *

UNITED STATES PATENT AND TRADEMARK OFFICE

CERTIFICATE OF CORRECTION

PATENT NO. : 7,925,030 B2
APPLICATION NO. : 11/482595
DATED : April 12, 2011
INVENTOR(S) : Holmstrom et al.

It is certified that error appears in the above-identified patent and that said Letters Patent is hereby corrected as shown below:

On the Title Page, Item (54), in Title, Line 2, delete "IMPEDENCE" and insert -- IMPEDANCE --, therefor.

In Column 1, Line 2, delete "IMPEDENCE" and insert -- IMPEDANCE --, therefor.

In Column 5, Line 40, delete ""μ"" and insert -- "||" --, therefor.

In Column 5, Line 55, in Equation (3), delete "$R_A=R_BR>>R_0$" and insert -- $R_A=R_B=R>>R_0$ --, therefor.

In Column 9, Line 14, delete "$R_S=100\Omega$," and insert -- $R_S=10\Omega$, --, therefor.

Signed and Sealed this
Twenty-third Day of August, 2011

David J. Kappos

David J. Kappos
*Director of the United States Patent and Trademark Office*